US012318013B1

(12) United States Patent
Johnson

(10) Patent No.: US 12,318,013 B1
(45) Date of Patent: Jun. 3, 2025

(54) HEIGHT ADJUSTMENT MECHANISM FOR FURNITURE

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 181 days.

(21) Appl. No.: 18/128,014

(22) Filed: Mar. 29, 2023

(51) Int. Cl.
*A47C 3/40* (2006.01)

(52) U.S. Cl.
CPC ..... *A47C 3/40* (2013.01)

(58) Field of Classification Search
CPC ..... A47C 3/40; A47C 3/285; A47C 3/28
See application file for complete search history.

(56) References Cited

U.S. PATENT DOCUMENTS

| | | | | |
|---|---|---|---|---|
| 1,270,976 | A * | 7/1918 | Schade | A47C 3/285 403/368 |
| 2,613,735 | A | 10/1952 | Fisher | |
| D169,696 | S | 5/1953 | Bies | |
| 5,094,422 | A | 3/1992 | Tiffany | |
| 7,036,886 | B2 | 5/2006 | Benden | |
| 7,452,034 | B2 | 11/2008 | Jung | |
| D591,537 | S | 5/2009 | Zhang | |
| 7,597,392 | B1 | 10/2009 | Gilmore | |
| D679,923 | S | 4/2013 | Corcorran | |
| 8,534,685 | B1 | 9/2013 | Tohm, Sr. | |
| D694,562 | S | 12/2013 | Lenterman | |
| 8,807,648 | B2 | 8/2014 | Carroll | |
| 8,915,517 | B1 | 12/2014 | Jacobs | |
| 8,973,926 | B1 | 3/2015 | Lensing | |
| D726,986 | S | 4/2015 | Hall | |
| 9,254,041 | B2 | 2/2016 | Kessler | |
| 9,924,805 | B2 | 3/2018 | Cass | |
| D829,031 | S | 9/2018 | Izawa | |
| 10,136,737 | B2 | 11/2018 | Cass | |
| 10,918,098 | B2 | 2/2021 | Morehead | |
| 10,993,530 | B2 | 5/2021 | Cass | |

(Continued)

FOREIGN PATENT DOCUMENTS

| | | |
|---|---|---|
| GB | 90026160450006 | 1/2015 |
| GB | 90027278180013 | 6/2015 |
| KR | 3007686120000 | 10/2014 |

OTHER PUBLICATIONS

DNA Motoring Stool, Posted Sep. 6, 2021 [online], [retrieved Oct. 25, 2024]. Retrieved from internet, https://a.co/d/aLexXYD (Year: 2021).

(Continued)

*Primary Examiner* — David R Dunn
*Assistant Examiner* — Tania Abraham
(74) *Attorney, Agent, or Firm* — Kenneth C. Booth; Booth Udall Fuller, PLC

(57) ABSTRACT

A height adjustment mechanism for a chair with a housing and an adjustment lever. The housing is fixed to the base of the chair and is slidably coupled to a post supporting the chair seat. The height of the seat above the base of the chair is dependent on a position of the post with respect to the housing. The adjustment lever is positioned within the housing and has two plates joined by a spring configured to bias the two plates in opposite directions. A free end of the adjustment lever is movable between a locked position and an active position. When in the locked position, the height of the seat is fixed. When in the active position, the height of the seat is adjustable.

20 Claims, 16 Drawing Sheets

(56) References Cited

U.S. PATENT DOCUMENTS

| | | | | |
|---|---|---|---|---|
| 11,470,971 | B2 | 10/2022 | Saad | |
| 11,470,973 | B1 | 10/2022 | Yu | |
| 11,612,247 | B1 | 3/2023 | Rusch | |
| D1,025,737 | S | 5/2024 | Hu | |
| 2011/0316313 | A1 | 12/2011 | Gasser | |
| 2012/0205949 | A1 | 8/2012 | Nguyen | |
| 2013/0146739 | A1 | 6/2013 | Zhao | |
| 2017/0066121 | A1 | 3/2017 | Huang | |
| 2020/0329873 | A1* | 10/2020 | Sun | A47C 3/40 |
| 2023/0323697 | A1 | 10/2023 | Audenaerde | |
| 2024/0156252 | A1 | 5/2024 | Cass | |

OTHER PUBLICATIONS

Goplus Mechanic Stool, Posted Oct. 13, 2022 [online], [retrieved Oct. 25, 2024]. Retrieved from internet, https://www.amazon.com/Goplus-Adjustable-Pneumatic-Removable-Universal/dp/B0BJ2HM7P3 (Year: 2022).

PowerSmart Rolling Stool, posting date unavailable [online], [retrieved Oct. 25, 2024]. Retrieved from internet, https://a.co/d/b0900CB ( Year: 2024).

* cited by examiner

HEIGHT ADJUSTMENT MECHANISM FOR FURNITURE

TECHNICAL FIELD

Aspects of this document relate generally to a height adjustment mechanism, and more specifically to a height adjustment mechanism for a chair.

BACKGROUND

Chairs and stools designed for office and workshop use frequently are designed to have an adjustable height to accommodate different sizes of users and different desk and worktable heights. Pneumatic mechanisms are often implemented to enable this height adjustment. When a user sits in an office chair and adjusts the height, the chair drops to the lowest height, and then must be adjusted upward as desired by the user.

SUMMARY

Aspects of this document relate to a chair height adjustment mechanism comprising a chair having a base configured to support the chair on a horizontal surface and a chair seat positioned above the base, a housing fixedly coupled to the base of the chair, the housing having an upper plate with an upper aperture extending therethrough and a lower plate parallel to the upper plate with a lower aperture extending therethrough, wherein the lower plate is joined to the upper plate by a housing wall and wherein the housing is slidably coupled to a post supporting the chair seat, the post extending through the upper aperture and the lower aperture, wherein a height of the chair seat above the base of the chair is dependent on a position of the post with respect to the housing, an adjustment lever positioned within the housing, the adjustment lever having a constrained end, a free end distal to the constrained end protruding from the housing, and at least two plates extending between the constrained end and the free end, wherein the post extends through the at least two plates and wherein the at least two plates are joined by at least one spring configured to bias the at least two plates in opposite directions and clamp the post with the at least two plates, and a lever support positioned within the housing and configured as a fulcrum for the adjustment lever, wherein the lever support is positioned to hold the constrained end of the adjustment lever adjacent the upper plate of the housing and wherein the lever support is integrated into the housing wall, wherein the free end of the adjustment lever is movable between a locked position and an active position, wherein when the free end is in the locked position, the adjustment lever is angled with respect to the post and the height of the chair seat above the base of the chair is fixed, and wherein when the free end is in the active position, the adjustment lever is perpendicular to the post and the height of the chair seat above the base of the chair is adjustable, and wherein when an upward force is exerted on the post with respect to the housing, the post is configured to move the free end of the adjustment lever into the active position, allowing the chair seat to move upward with respect to the base, and when a downward force is exerted on the post with respect to the housing without an upward force being exerted on the adjustment lever while the adjustment lever is in the active position, the post is configured to move the free end of the adjustment lever into the locked position as the chair seat moves downward with respect to the base.

Particular embodiments may comprise one or more of the following features. The at least one spring may comprise at least two springs. An intermediate plate positioned between the at least two plates, wherein the at least one spring passes through the intermediate plate without engaging with the intermediate plate. Each of the housing and the adjustment lever may comprise sheet metal. The post may have an upper stop and a lower stop each configured to limit a range of motion of the post and the chair seat.

Aspects of the disclosure relate to a furniture height adjustment mechanism comprising a chair having a base configured to support the chair on a surface and a chair seat positioned above the base, a housing fixedly coupled to the base of the chair and slidably coupled to a post supporting the chair seat, the post extending through the housing, wherein a height of the chair seat above the base of the chair is dependent on a position of the post with respect to the housing, an adjustment lever positioned within the housing, the adjustment lever having a constrained end, a free end distal to the constrained end protruding from the housing, and at least two plates extending between the constrained end and the free end, wherein the post extends through the at least two plates and wherein the at least two plates are joined by at least one spring configured to bias the at least two plates in opposite directions and clamp the post with the at least two plates, and a lever support within the housing configured as a fulcrum for the adjustment lever, wherein the lever support is positioned to hold the constrained end of the adjustment lever between the lever support and the housing, wherein the free end of the adjustment lever is movable between a locked position and an active position, wherein when the free end is in the locked position, the height of the chair seat above the base of the chair is fixed, and wherein when the free end is in the active position, the height of the chair seat above the base of the chair is adjustable, and wherein when an upward force is exerted on the post with respect to the housing, the post pulls the free end of the adjustment lever into the active position and wherein the adjustment lever is configured to move into the locked position when the chair seat moves downward with respect to the base unless the adjustment lever is manually maintained in the active position.

Particular embodiments may comprise one or more of the following features. An upper plate with an upper aperture extending therethrough and a lower plate with a lower aperture extending therethrough, wherein the lower plate is joined to the upper plate by a housing wall and wherein the post extends through the upper aperture and the lower aperture. The lever support may be integrated into at least one of the housing wall, the upper plate and the lower plate, and wherein the lever support may be positioned to hold the constrained end of the adjustment lever between the lever support and the upper plate. When the adjustment lever is in the locked position, the adjustment lever may be angled with respect to the post. An intermediate plate positioned between the at least two plates, wherein the at least one spring passes through the intermediate plate without engaging with the intermediate plate.

Aspects of the disclosure relate to a furniture height adjustment mechanism comprising a housing slidably coupled to a post extending through the housing, and an adjustment lever positioned within the housing, a free end of the adjustment lever protruding from the housing, wherein the adjustment lever has at least two plates joined by at least one spring configured to bias the at least two plates in opposite directions, wherein the free end of the adjustment lever is movable between a locked position and an active position, wherein when the free end is in the locked position, the height of the chair seat above the base of the chair is fixed, and wherein when the free end is in the active position, the height of the chair seat above the base of the chair is adjustable.

Particular embodiments may comprise one or more of the following features. The housing may have an upper plate and a lower plate with the lower plate joined to the upper plate by a housing wall. A lever support configured as a fulcrum for the adjustment lever, the adjustment lever having a constrained end distal to the free end positioned between the lever support and the upper plate. The lever support may be integrated into the housing wall. When an upward force is exerted on the post with respect to the housing, the post may be configured to pull the free end of the adjustment lever into the active position, allowing the post to move upward with respect to the housing. When a downward force is exerted on the post with respect to the housing without an upward force being exerted on the adjustment lever while the adjustment lever is in the active position, the post is configured to pull the free end of the adjustment lever into the locked position as the post moves downward with respect to the housing. When the adjustment lever is in the locked position, the adjustment lever is angled with respect to the post. The height adjustment mechanism may be configured to control a vertical position of a chair seat. An intermediate plate may be positioned between the at least two plates, wherein the at least one spring passes through the intermediate plate without engaging with the intermediate plate. A chair having a base configured to support the chair on a horizontal surface and a chair seat positioned above the base and mounted to the post, wherein a height of the chair seat above the base of the chair is dependent on a position of the post with respect to the housing.

The foregoing and other aspects, features, and advantages will be apparent from the specification, drawings, and the claims.

BRIEF DESCRIPTION OF THE DRAWINGS

Implementations will hereinafter be described in conjunction with the appended drawings, where like designations denote like elements, and.

Figure 1:
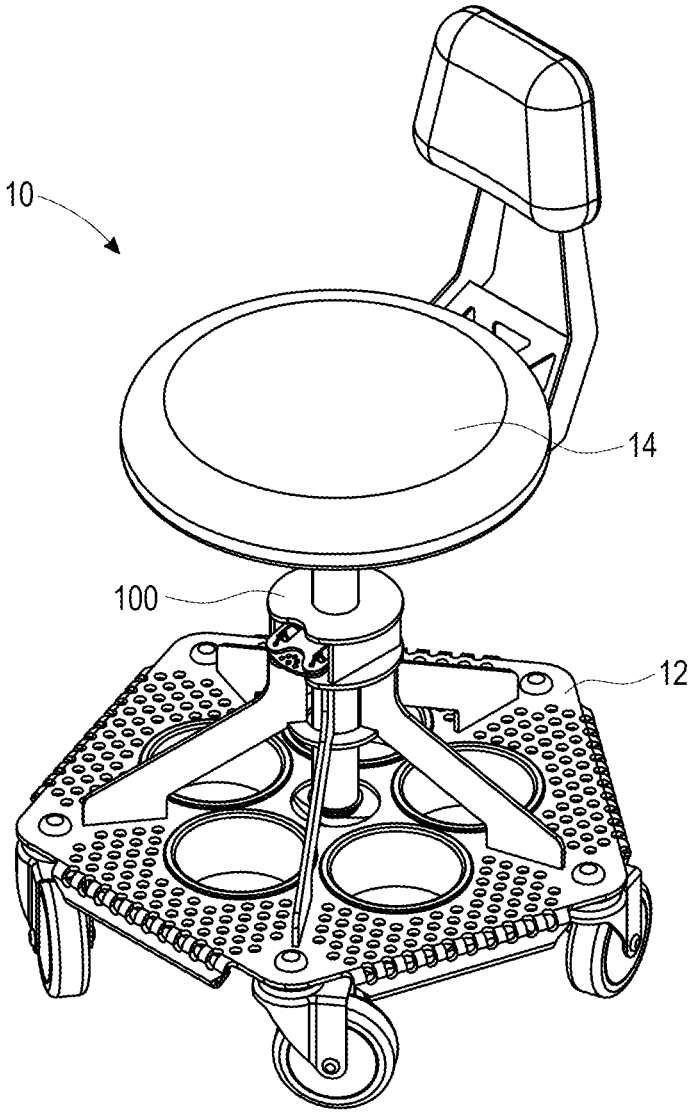
FIG. 1 is a perspective view of a chair with a height adjustment mechanism.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms “a,” “an,” and “the” include plural referents unless the context clearly dictates otherwise. Thus, for example, reference to “a step” includes reference to one or more of such steps.

The word “exemplary,” “example,” or various forms thereof are used herein to mean serving as an example, instance, or illustration. Any aspect or design described herein as “exemplary” or as an “example” is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

Figure 2:
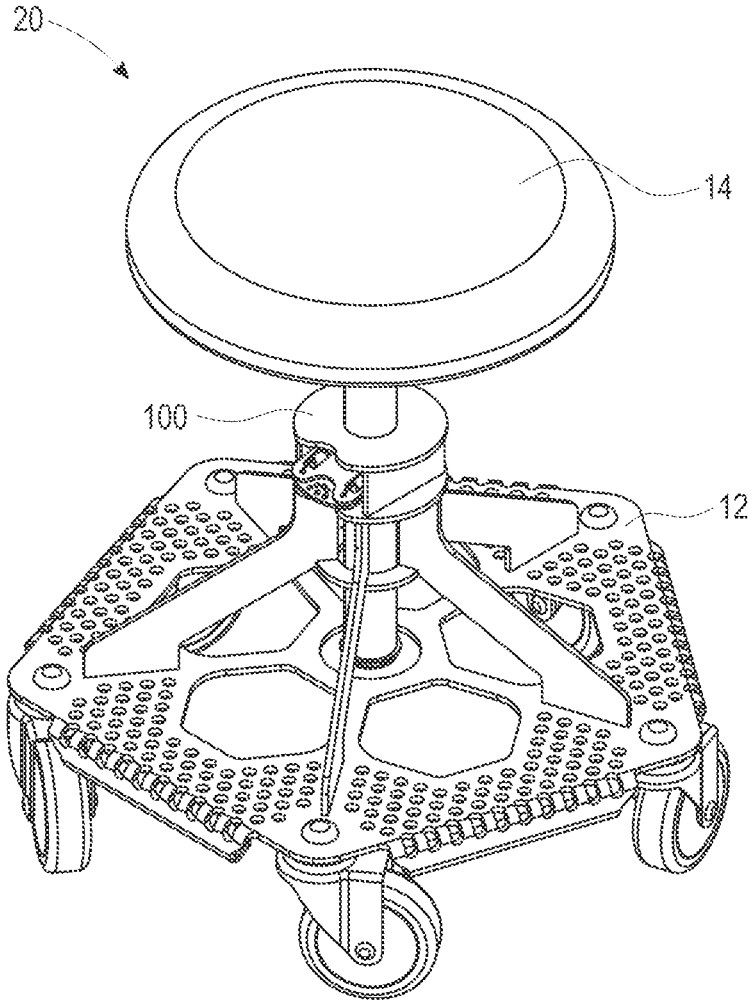
FIG. 2 is a perspective view of a stool with the height adjustment mechanism shown in FIG. 1.
Figure 3:
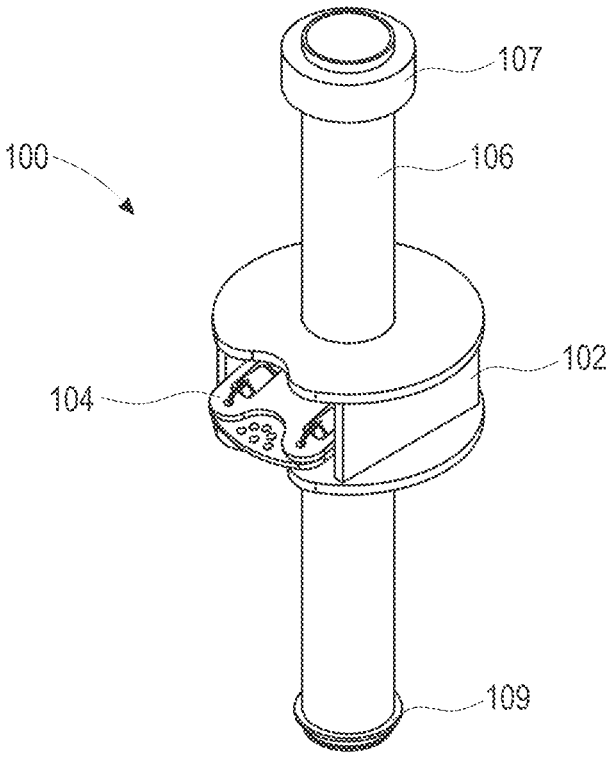
FIG. 3 is a perspective view of the height adjustment mechanism shown in FIG. 1 on a post.
Figure 4:
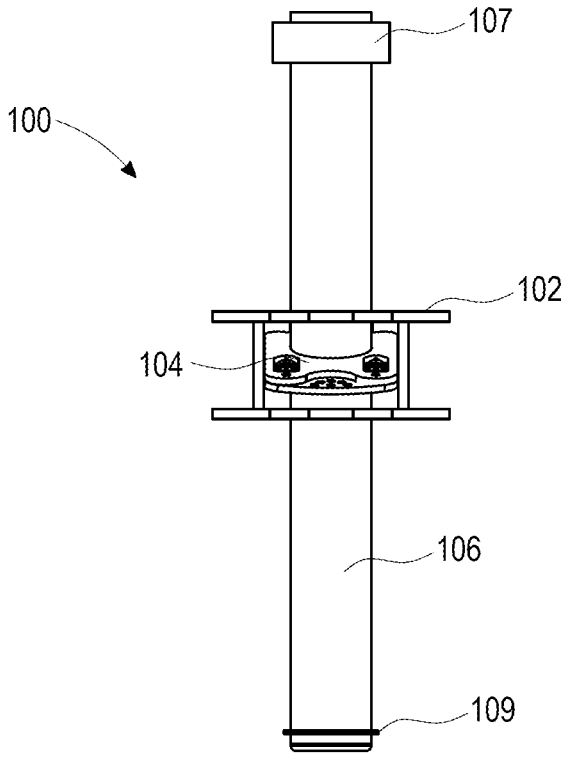
FIG. 4 is a front view of the height adjustment mechanism and post shown in FIG. 3.
Figure 5:
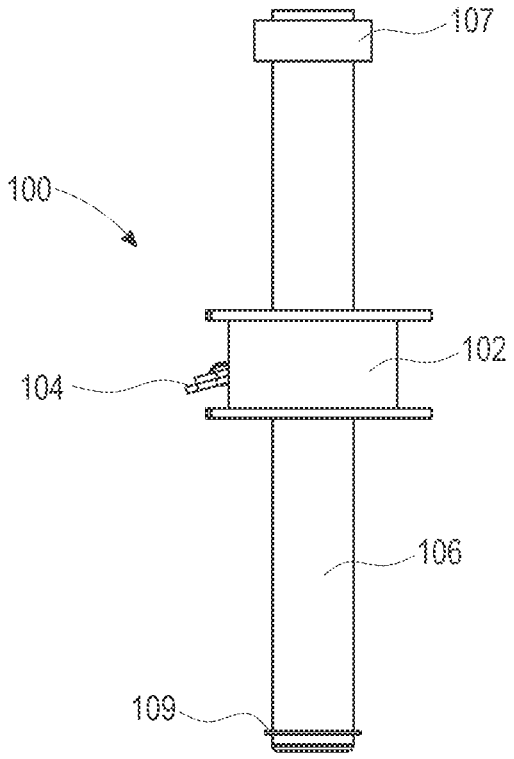
FIG. 5 is a side view of the height adjustment mechanism and post shown in FIG. 3.

The present disclosure is related to a linear position clutch 100 for adjusting a position of a clutch mechanism along a guide. In a particular implementation, the linear position clutch 100 is used as a height adjustment mechanism 100 for furniture such as a chair 10 or stool 20, as shown in FIGS. 1 and 2. Throughout this disclosure, it is intended that any reference to a chair 10 or a stool 20 also be applicable to the other of the chair 10 and the stool 20. For example, a majority of the following examples and descriptions that follow refer to a chair 10. However, as will be apparent to one of skill in the art, in each example and description, a stool 20 could instead be used with the same effect. The height adjustment mechanism 100 may be implemented on other pieces of furniture as well, such as, without limitation, tables, other seating furniture, lecterns and cabinets. The height adjustment mechanism 100, or linear position clutch 100, may also be implemented as a component in other non-furniture items such as, without limitation, non-furniture ground-based supports like trade show banner stands, plant stands, supports for hanging drywall on a ceiling, and the like; ground or table-top supports such as a camera tripod, microphone stand, computer monitor stand, and the like; and non-ground, non-vertical supports such as exercise equipment back pad position locks, car hood supports, truck horizontal load braces, and the like. Although the chair and stool examples provided herein primarily rely apply the linear position clutch 100 in a vertical, height adjustment implementation, the linear position clutch 100 may be applied in any situation where a position adjustment lock or position adjustment clutch is useful and is not limited to either solely horizontal or vertical applications.

The height adjustment mechanism 100 is configured to adjust the height of the chair 10 in a way that is easier to find the desired height, as will be discussed in more detail below. Broadly speaking, the height adjustment mechanism is configured to allow the chair 10 to lift or lower to any desired height in one motion, similar to a conventional adjustable chair. However, the height adjustment mechanism 100 may be configured to undergo this motion without rapid or hard-to-control movements. This is different from a conventional adjustable chair that, once unlocked, may move upward or downward quickly and therefore be difficult to adjust precisely. The chair 10 may comprise a base 12 that is configured to support the chair 10 on a horizontal surface such as the ground or the floor. The chair 10 may also comprise a seat 14 positioned above the base 12 that is configured to support a user when the user sits in the chair 10. The height adjustment mechanism 100 may be configured to control a vertical position of the seat 14 with respect to the base 12.

Turning to FIGS. 3-6, the height adjustment mechanism 100 comprises a housing 102 and an adjustment lever 104. The housing 102 is configured to couple or attach to the base 12. The housing 102 may be fixedly coupled to the base 12 or may be rotationally coupled to the base 12 such that the base 12 can rotate with respect to the housing 102. In some embodiments, the housing 102 may be configured to remain at a constant height with respect to the horizontal surface on which the base 12 rests. Thus, in such embodiments, even as the chair 10 is adjusted to different heights, the housing 102 does not move up and down. In other embodiments, the housing 102 may also be fixedly coupled to the seat 14 such that the housing 102 moves up and down with the seat, changing height with respect to the horizontal surface but remaining at a constant distance from the seat 14.

The housing 102 is configured to slidingly couple with a post 106. The post 106 may have a circular cross section, as shown in FIGS. 3-8. However, in some embodiments, the post 106 has a noncircular cross section. Any shape may be used for the cross section of the post 106. A noncircular cross section may be implemented in the post 106 in embodiments where rotation of the seat 14 with respect to the base 12 is not desired. In some embodiments, the post 106 is solid, hollow, and/or an open section. The post 106 may be fixedly attached to whichever of the base 12 and the seat 14 that the housing 102 is not attached to. For example, as shown in FIGS. 3-6, when the housing 102 is attached to the base 12, the post 106 may be attached to the seat 14. The post 106 may have an upper stop 107 and a lower stop 109 each configured to limit a range of motion of the post 106 and the seat 14 with respect to the base 12. The upper stop 107 may provide an upper limit and the lower stop 109 may provide a lower limit. As will be apparent to one of skill in the art, additional components may be included in the chair 10 without affecting the interaction between the housing 102, the adjustment lever 104, and the post 106 described herein. For example, additional height adjustment devices or rotational devices may be included to supplement the motion provided by the height adjustment mechanism 100 disclosed herein.

The housing 102 may have an upper plate 108 and a lower plate 110. Each of the upper plate 108 and the lower plate 110 may have a circular shape as shown in FIGS. 3-6, or may have any other shape. In some embodiments, the upper plate 108 and the lower plate 110 are parallel with each other. The upper plate 108 may have an upper aperture 112 extending therethrough. Similarly, the lower plate 110 may have a lower aperture 114 extending therethrough. The upper aperture 112 and the lower aperture 114 may be aligned with each other and may be sized to receive the post 106. Thus, the upper aperture 112 and the lower aperture 114 may be configured to maintain the housing 102 in an appropriate orientation with respect to the post 106. When in this appropriate orientation, the upper plate 108 and the lower plate 110 may be perpendicular to the post 106.

The upper plate 108 and the lower plate 110 may be joined together by a housing wall 116. The housing wall 116 may have a square or rectangular shape, as shown in FIGS. 3-6, or may have any other shape. As mentioned above, the housing 102 is slidingly coupled to the post 106. The post 106 may support the seat 14 of the chair 10. The seat 14 may be mounted on the post 106 such that a height of the seat 14 of the chair 10 above the base 12 of the chair 10 is dependent on a position of the post 106 with respect to the housing 102. In some embodiments, the post 106 extends through the upper aperture 112 and the lower aperture 114 to slidingly couple the housing 102 to the post 106. In other embodiments, the post 106 is slidingly coupled to the housing 102 in another way.

Figure 8:
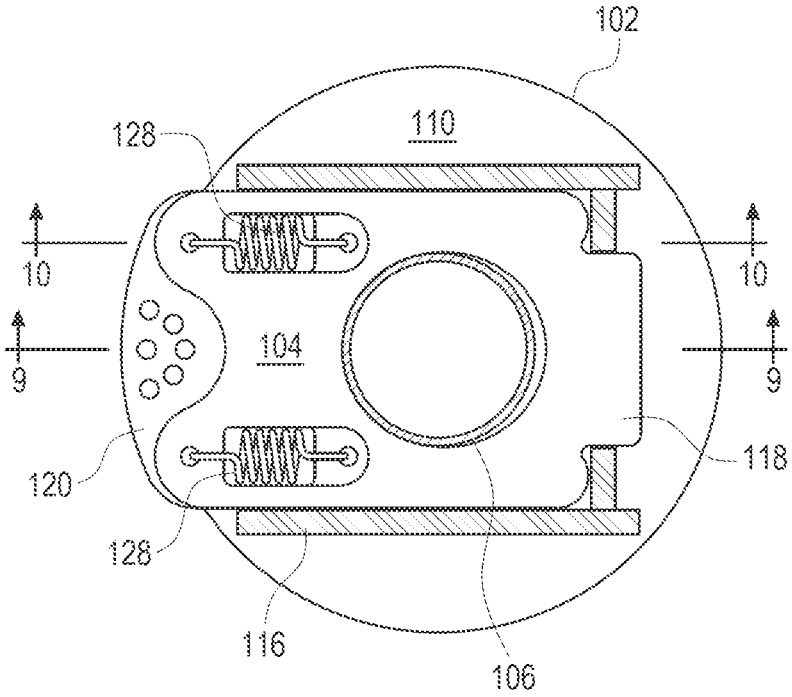
FIG. 8 is a cross section view taken from line 8-8 in FIG. 7B showing the adjustment lever.

The adjustment lever 104 is positioned within the housing 102 and may have a constrained end 118 and a free end 120 distal to the constrained end 118. The adjustment lever 104 may be sized and/or shaped to fit snugly within the housing 102, as shown in FIG. 8. By having surfaces on the adjustment lever 104 and the housing 102 that line up with each other, the housing 102 is able to guide the adjustment lever 104 as the adjustment lever 104 moves to limit rotation of the adjustment lever 104 about the post 106. This helps to maintain the adjustment lever 104 in a more predictable location and reduces the chance of the components of the adjustment lever 104 misaligning and jamming. In some embodiments, the adjustment lever 104 fits snugly within the housing 102 on all sides of the adjustment lever 104, while in other embodiments, only some of the surfaces of the adjustment lever 104 and the housing 102 are configured to align. Other components could also be included to provide the benefits of limiting rotation of the adjustment lever 104 and reducing the chance of misalignment and jamming of the adjustment lever 104.

Figure 6:
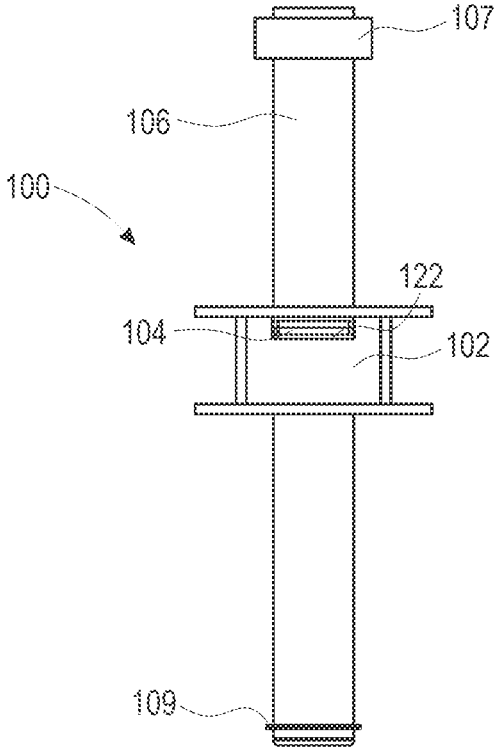
FIG. 6 is a back view of the height adjustment mechanism and post shown in FIG. 3.
Figure 9B:
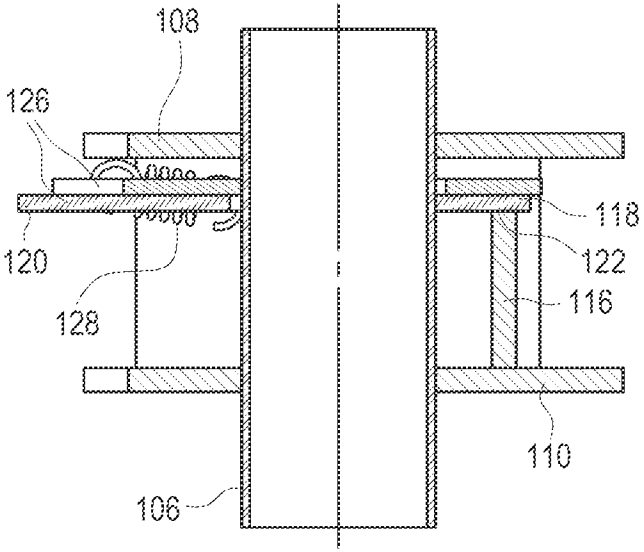
FIG. 9B is a cross section view taken from line 9-9 in FIG. 8 with the adjustment lever in the active position.
Figure 9A:
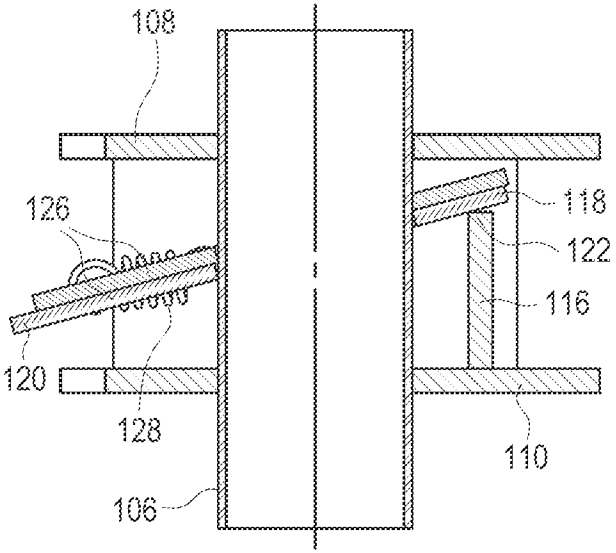
FIG. 9A is a cross section view taken from line 9-9 in FIG. 8 with the adjustment lever in the locked position.

A lever support 122 may be configured as a fulcrum for the adjustment lever 104. The lever support 122 may be positioned within the housing 102 or adjacent the housing 102 to hold the constrained end 118 of the adjustment lever 104 adjacent the upper plate 108 of the housing 102. The lever support 122 may be integrated into the housing wall 116, as shown in FIGS. 6, 9A, and 9B. However, the lever support 122 may also be a separate component, distinct from the housing wall 116. For example, the lever support 122 could be configured as a narrow or wide post extending up from the lower plate 110 within the housing 102 to support the constrained end 118 of the adjustment lever 104 near the upper plate 108, as a beam suspended from the housing wall 116, lower plate 110 and/or upper plate 108 to support the constrained end 118 of the adjustment lever 104 near the upper plate 108, or any other structure that could act as a fulcrum or support for the adjustment lever 104. In embodiments where the lever support 122 is distinct from the housing wall 116, the housing wall 116 may obscure and/or enclose the lever support 122 within the housing 102.

The free end 120 of the adjustment lever 104 may protrude from the housing 102 and is configured to be manually engaged to adjust the height of the seat 14 above the base 12. The post 106 may extend through the adjustment lever 104 between the constrained end 118 and the free end 120 to allow the adjustment lever 104 to engage with the post 106. To this end, the adjustment lever may have a central aperture 124 extending through the adjustment lever to allow the post 106 to extend through the adjustment lever 104. The central aperture 124 may be sized slightly larger than the cross section of the post 106 to allow the adjustment lever 104 to move with respect to the post 106.

Figure 7B:
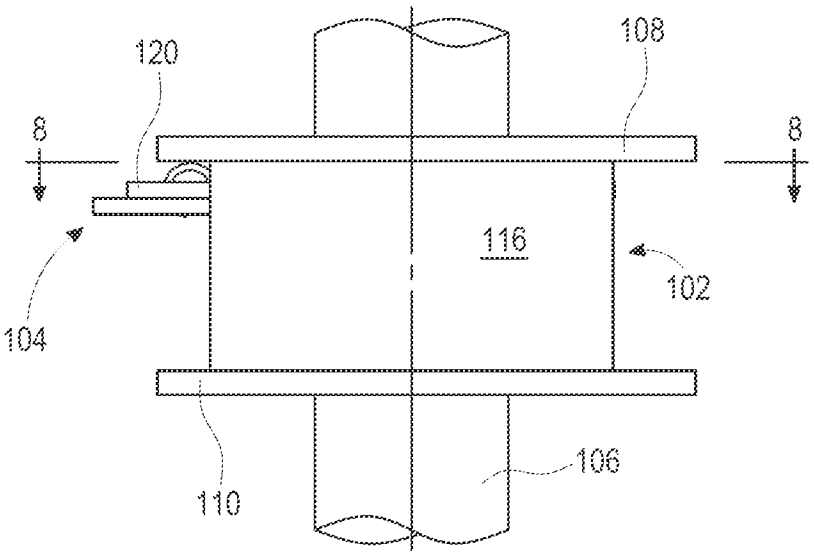
FIG. 7B is a close-up side view of the height adjustment mechanism shown in FIG. 3 with the adjustment lever in the active position.
Figure 7A:
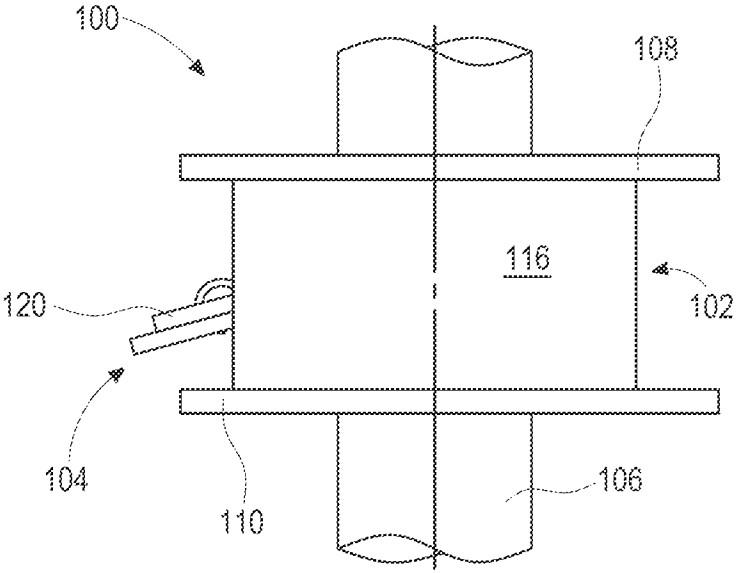
FIG. 7A is a close-up side view of the height adjustment mechanism shown in FIG. 3 with the adjustment lever in the locked position.

The adjustment lever 104 is movable between a locked position shown in FIG. 7A and an active position shown in FIG. 7B. When in the locked position, the free end 120 of the adjustment lever 104 is angled with respect to the post 106, meaning that the free end 120 is neither parallel with nor perpendicular to the post 106 when in the locked position. Additionally, when the adjustment lever 104 and/or the free end 120 are in the locked position, the height of the seat 14 above the base 12 of the chair 10 is fixed. On the other hand, when in the active position, the adjustment lever 104 may be perpendicular to the post 106 and the height of the seat 14 above the base 12 of the chair 10 is adjustable.

In some circumstances, the adjustment lever 104 is configured to move between the active position and the locked position without direct manipulation by the user. In some embodiments, this automatic movement of the adjustment lever 104 is caused by the interaction between the adjustment lever 104 and the post 106 illustrated in FIGS. 8-9B. Because the post 106 extends through the adjustment lever 104, some friction exists between these two components. Thus, when a downward force is exerted on the post 106, such as by the weight of the seat 14 or the weight of a user sitting on the seat 14, the post 106 passes this force on to the adjustment lever 104 through friction. Because the constrained end 118 of the adjustment lever 104 is constrained while the free end 120 is able to move up and down and because the central aperture 124 is larger than the cross section of the post 106, as long as there is no upward force being exerted on the adjustment lever 104, either manually or otherwise, to counteract the downward force, the adjustment lever 104 moves into the locked position in response to the downward force, where the adjustment lever 104 is angled with respect to the post 106. This causes the edges of the central aperture 124 to tighten onto the post 106 as shown in FIG. 9A, preventing further movement between the adjustment lever 104 and the post 106.

Similarly, when an upward force is applied to the post 106 either directly or through lifting the seat 14 of the chair 10, the post 106 transfers this force through friction to the adjustment lever 104, lifting the adjustment lever 104 into the active position. This also loosens the grip of the adjustment lever 104 on the post 106 as shown in FIG. 9B, allowing the post 106 to move upward as far as desired, depending on the height of the seat 14 desired by the user. Once the user stops applying the upward force, the weight of the seat 14 and the user, if the user sits on the seat 14, moves the post 106 downward as described above. This automatically moves the adjustment lever 104 into the locked position, thus preventing the post 106 from moving further downward as described above.

Because the post 106 is configured to automatically move the adjustment lever 104 into the locked position with just the weight of the seat 14 applied, and especially when the user is also sitting on the chair 10, downward motion of the seat 14 with respect to the base 12 may occur in discrete increments under the user's control if the user intermittently activates and releases the adjustment lever 104 out of and into the locked position. Each of these discrete increments is roughly equal to the distance the adjustment lever 104 travels from the active position to the locked position because, as the post 106 moves downward, it pulls the adjustment lever 104 with it until the adjustment lever 104 tightens onto the post 106 in the locked position. However, the user may also manually hold the adjustment lever 104 in the active position so that the seat 14 can move downward with respect to the base 12 in one motion as well. Because there is still friction between the post 106 and the adjustment lever 104, this downward motion is still controlled.

Figure 10:
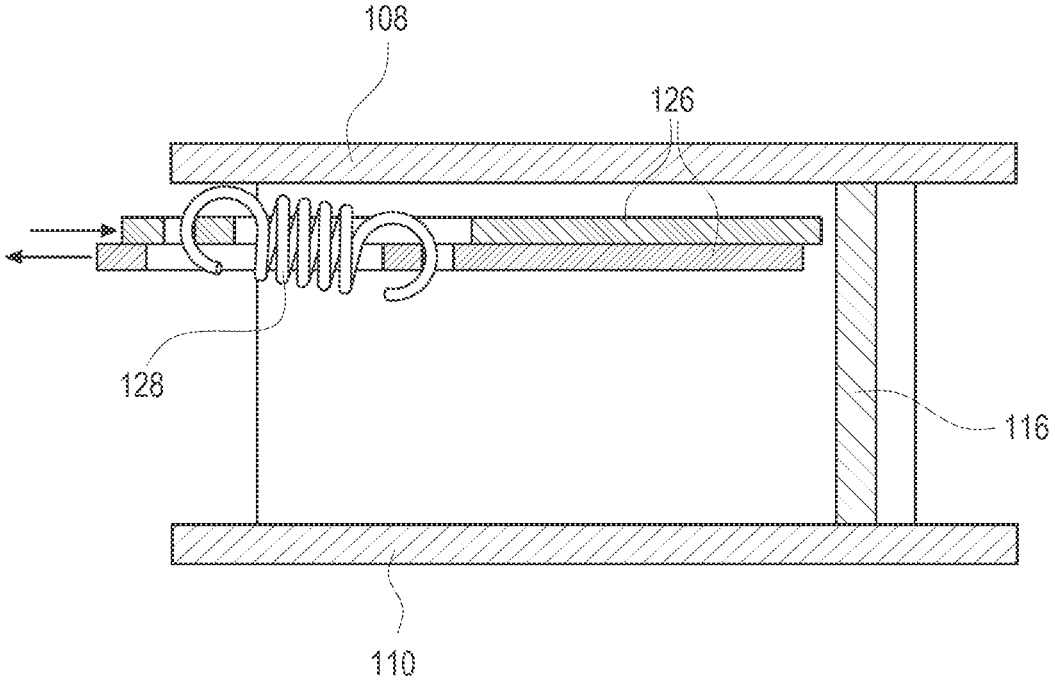
FIG. 10 is a cross section view taken from line 10-10 in FIG. 8 with the adjustment lever in the active position, showing the spring joining the two plates of the adjustment lever.
Figure 11B:
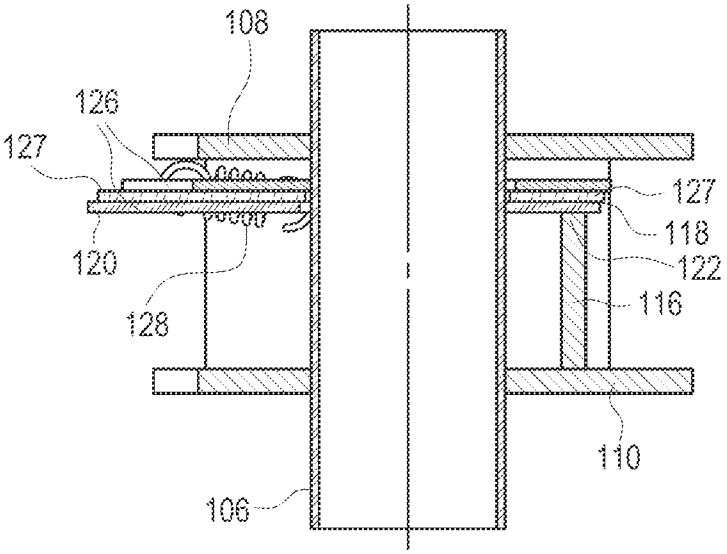
FIG. 11B is a cross section view taken from line 9-9 in FIG. 8 with an intermediate plate and with the adjustment lever in the active position.
Figure 11A:
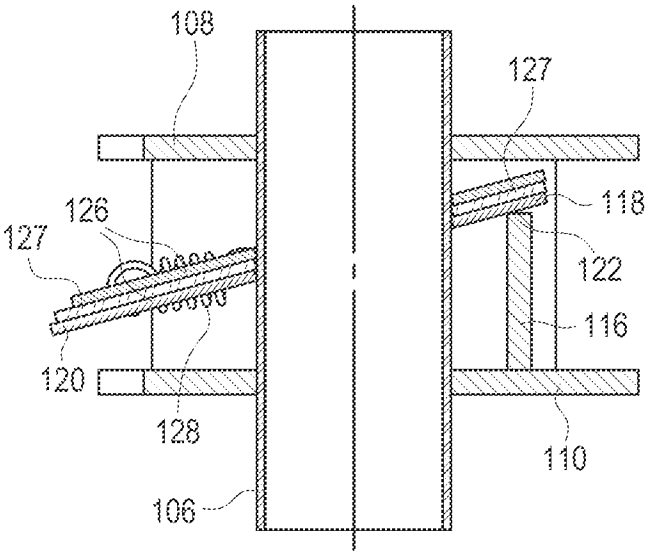
FIG. 11A is a cross section view taken from line 9-9 in FIG. 8 with an intermediate plate and with the adjustment lever in the locked position.
Figure 12:
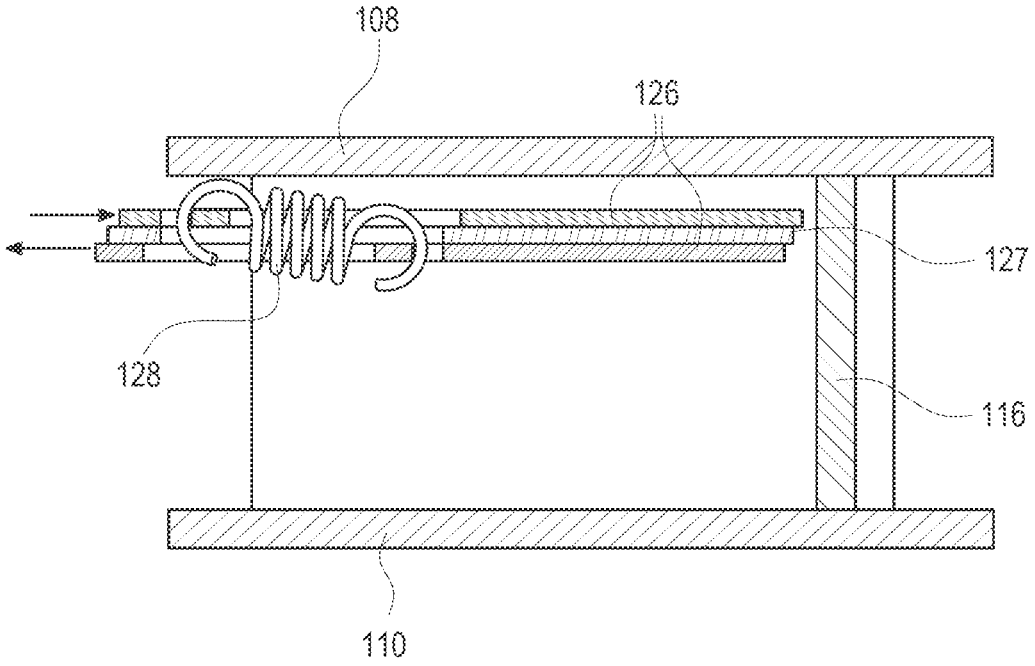
FIG. 12 is a cross section view taken from line 10-10 in FIG. 8 with the adjustment lever in the active position, showing the spring joining the two plates of the adjustment lever through an intermediate plate.

As shown in FIG. 10, the adjustment lever 104 may comprise at least two plates 126 configured to slide with respect to one another. The two plates 126 extend between the constrained end 118 and the free end 120. In some embodiments, the two plates 126 are in contact with one another, while in other embodiments, intermediate plates 127 are positioned between the two plates 126. The two plates 126 are joined together by at least one spring 128. In embodiments that include one or more intermediate plates 127, shown in FIGS. 11A-12, each intermediate plate 127 is positioned between the two plates 126, and the spring 128 passes through the intermediate plate 127 without engaging with the intermediate plate 127. The spring 128 is configured to bias the two plates 126 in opposite directions. This causes the two plates 126 to clamp onto the post 106 when the post 106 extends through the central aperture 124. Any number of springs 128 may be used to bias the two plates 126 in opposite directions, and any type of spring may be used. When the adjustment lever 104 is in the active position, the spring 128 pulls the two plates 126 against the post 106, but because the central aperture 124, which extends through both plates 126, is slightly larger than the post 106, the post 106 is still able to move through the central aperture 124 (see FIG. 9B). However, when the adjustment lever 104 is in the locked position, the corners of the two plates 126 as well as the corners of any intermediate plates 127 positioned between the two plates 126 dig into the post 106 to lock the post 106 in place (see FIGS. 9A and 11A).

Figure 13:
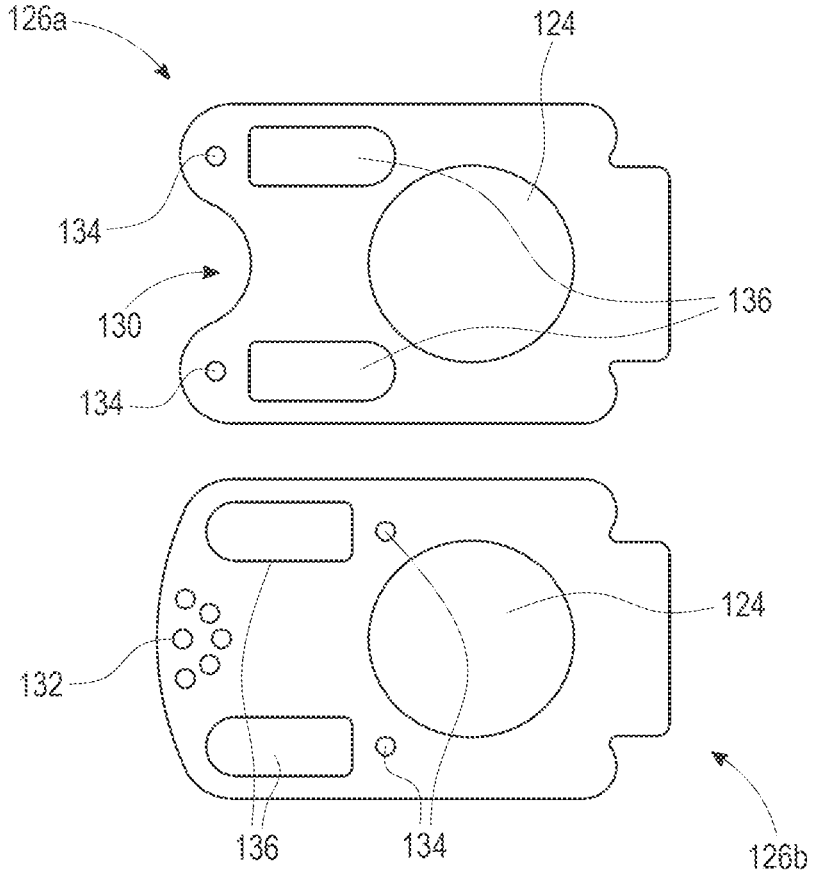
FIG. 13 is a top view of the two plates of the adjustment lever shown in FIG. 8.

As shown in FIG. 8, the adjustment lever 104 may have two springs 128 that are configured to work together to bias the two plates 126 in opposite directions. This allows the adjustment lever 104 to be more compact because the springs 128 can be offset from a centerline of the plates 126 without causing imbalances in the bias on the plates 126. FIG. 13 illustrates one embodiment of the top plate 126*a* and the bottom plate 126*b* of the two plates 126. The top plate 126*a* may have a notch 130 configured to expose a grip 132 on the bottom plate 126*b* when the two plate 126 are stacked on top of each other. The grip 132 facilitates gripping the adjustment lever 104 to move the adjustment lever 104 into the active position or into the locked position. The grip 132 may be a series of bumps, a series of holes, or any other feature that increases the grip of the adjustment lever 104. Each of the top plate 126*a* and the bottom plate 126*b* may also have hook apertures 134 configured to allow the spring 128 to hook into each plate 126 and spring apertures 136 configured to allow the spring 128 to extend through each plate 126. This facilitates coupling the two plates 126 together with the spring 128.

Figure 14:
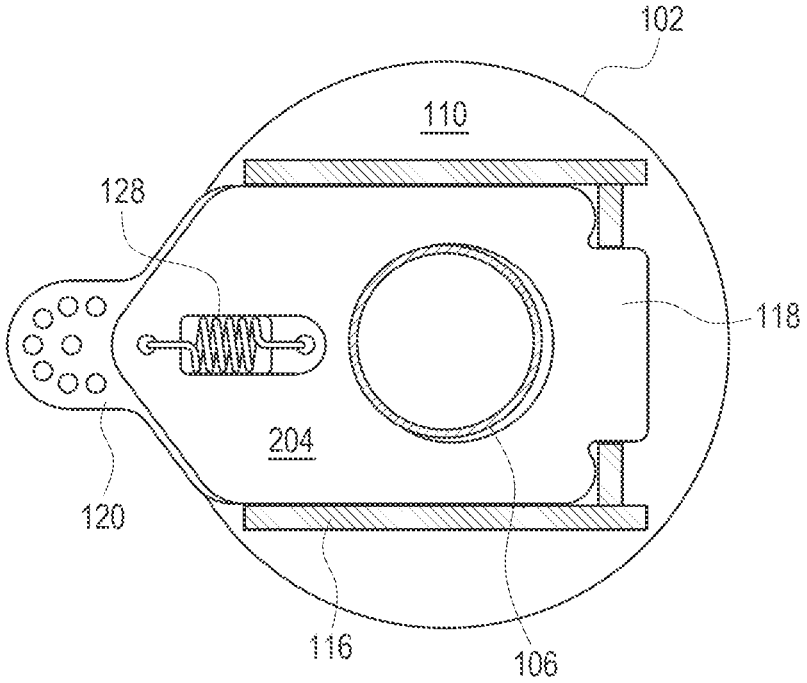
FIG. 14 is a cross section view similar to FIG. 8, but with an alternative adjustment lever embodiment.
Figure 15:
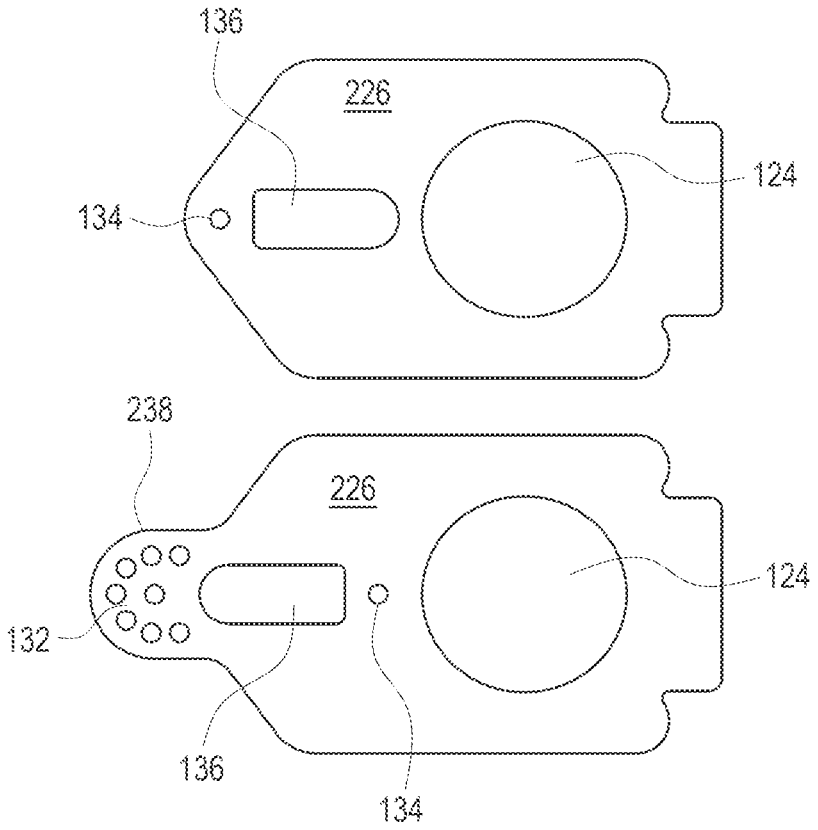
FIG. 15 is a top view of the two plates of the adjustment lever shown in FIG. 14.

As shown in FIGS. 14 and 15, in another embodiment, the adjustment lever 204 may also have one spring 128 configured to bias the two plates 226 in opposite directions. The plates 226 function in the same way as the plates 126 described above. In such an embodiment, the spring 128 may be aligned with a centerline of the plates 226. In addition to some components that the adjustment lever 204 shares with the adjustment lever 104, such as hook apertures 134 and spring apertures 136, the adjustment lever 204 may also have a tab 238 that extends away from the central aperture 124. The grip 132 may be positioned on the tab 238.

Figure 16:
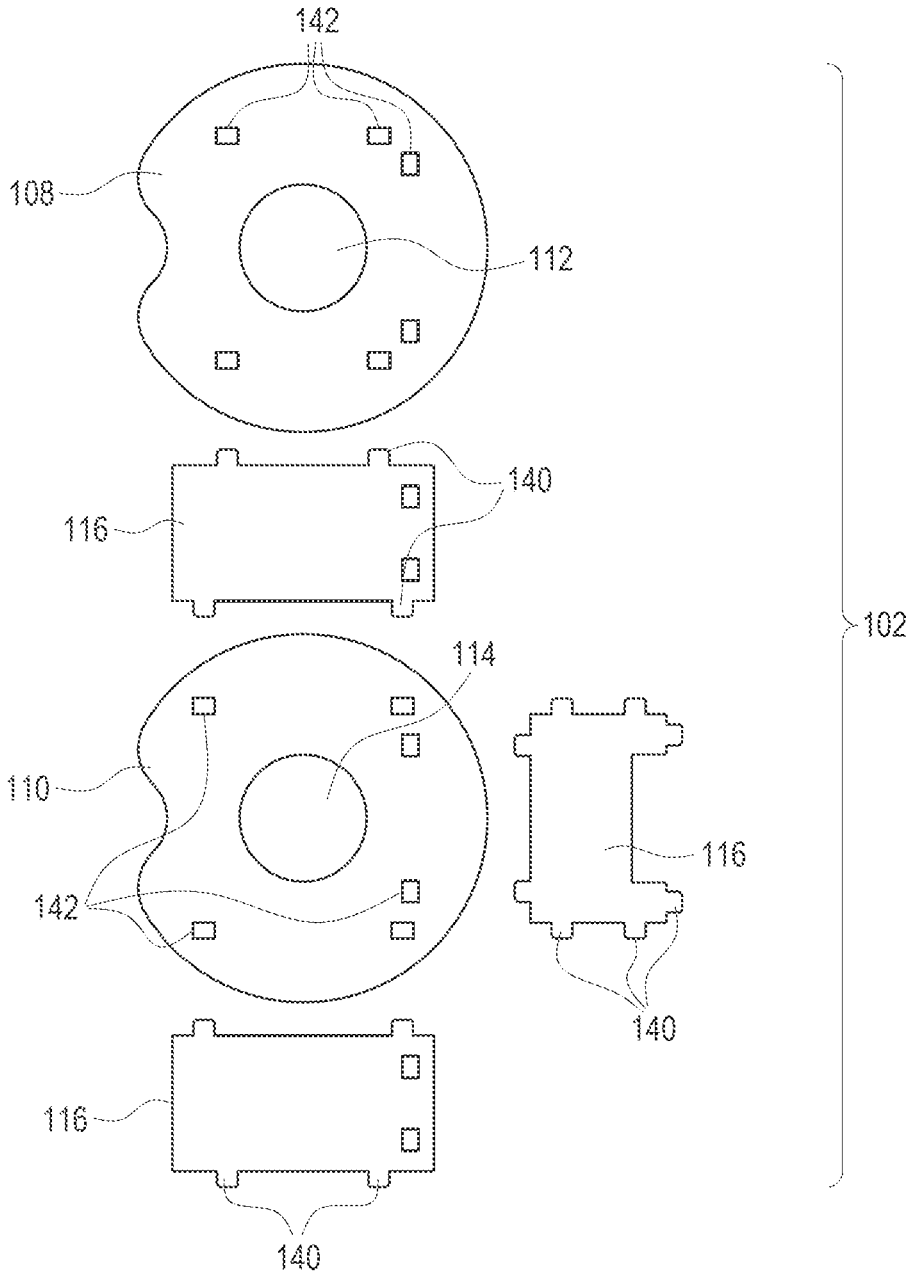
FIG. 16 is a top view of the components of a housing formed or fabricated from sheet metal.

In some embodiments, the housing 102 and/or the adjustment lever 104 comprise sheet metal. Thus, the housing 102 may be formed or fabricated from sheet metal. One such embodiment of the housing 102 is illustrated in FIG. 16, where the upper plate 108, the lower plate 110, and the housing wall 116 all are formed or fabricated from sheet metal, and thus may be cut, welded, bent, or stamped from sheet metal. Other manufacturing processes including, without limitation, at least CNC forming and injection molding may also be used. As shown, the components of the housing 102 may have mating tabs 140 and mating apertures 142 configured to allow the upper plate 108, the lower plate 110, and the housing wall 116 to be assembled together. The adjustment lever 104 may also be formed or fabricated from sheet metal or other method, as shown in FIGS. 9A-13.

It will be understood that implementations of a height adjustment mechanism are not limited to the specific assemblies, devices and components disclosed in this document, as virtually any assemblies, devices and components consistent with the intended operation of a height adjustment mechanism may be used. Accordingly, for example, although particular height adjustment mechanisms, and other assemblies, devices and components are disclosed, such may include any shape, size, style, type, model, version, class, measurement, concentration, material, weight, quantity, and/or the like consistent with the intended operation of height adjustment mechanisms. Implementations are not limited to uses of any specific assemblies, devices and components; provided that the assemblies, devices and components selected are consistent with the intended operation of a height adjustment mechanism.

Accordingly, the components defining any height adjustment mechanism may be formed of any of many different types of materials or combinations thereof that can readily be formed into shaped objects provided that the materials selected are consistent with the intended operation of a height adjustment mechanism. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various height adjustment mechanisms may be manufactured using conventional procedures as added to and improved upon through the procedures described here. Some components defining a height adjustment mechanism may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling height adjustment mechanisms are not limited to the specific order of steps as disclosed in this document. Any steps or sequence of steps of the assembly of a height adjustment mechanism indicated herein are given as examples of possible steps or sequence of steps and not as limitations, since various assembly processes and sequences of steps may be used to assemble height adjustment mechanisms.

The implementations of a height adjustment mechanism described are by way of example or explanation and not by way of limitation. Rather, any description relating to the foregoing is for the exemplary purposes of this disclosure, and implementations may also be used with similar results for a variety of other applications employing a height adjustment mechanism.

What is claimed is:

1. A chair height adjustment mechanism comprising:

a chair having a base configured to support the chair on a horizontal surface and a chair seat positioned above the base;

a housing fixedly coupled to the base of the chair, the housing having an upper plate with an upper aperture extending therethrough and a lower plate parallel to the upper plate with a lower aperture extending therethrough, wherein the lower plate is joined to the upper plate by a housing wall and wherein the housing is slidably coupled to a post supporting the chair seat, the post extending through the upper aperture and the lower aperture, wherein a height of the chair seat above the base of the chair is dependent on a position of the post with respect to the housing;

an adjustment lever positioned within the housing, the adjustment lever having a constrained end, a free end distal to the constrained end protruding from the housing, and at least two plates extending between the constrained end and the free end, wherein the post extends through the at least two plates and wherein the at least two plates are joined by at least one spring configured to bias the at least two plates in opposite directions and clamp the post with the at least two plates; and a lever support positioned within the housing and configured as a fulcrum for the adjustment lever, wherein the lever support is positioned to hold the constrained end of the adjustment lever adjacent the upper plate of the housing and wherein the lever support is integrated into the housing wall;

wherein the free end of the adjustment lever is movable between a locked position and an active position, wherein when the free end is in the locked position, the adjustment lever is angled with respect to the post and the height of the chair seat above the base of the chair is fixed, and wherein when the free end is in the active position, the adjustment lever is perpendicular to the post and the height of the chair seat above the base of the chair is adjustable; and wherein when an upward force is exerted on the post with respect to the housing, the post is configured to move the free end of the adjustment lever into the active position, allowing the chair seat to move upward with respect to the base, and when a downward force is exerted on the post with respect to the housing without an upward force being exerted on the adjustment lever while the adjustment lever is in the active position, the post is configured to move the free end of the adjustment lever into the locked position as the chair seat moves downward with respect to the base.

2. The chair height adjustment mechanism of claim 1, wherein the at least one spring is at least two springs.

3. The chair height adjustment mechanism of claim 1, further comprising an intermediate plate positioned between the at least two plates, wherein the at least one spring passes through the intermediate plate without engaging with the intermediate plate.

4. The chair height adjustment mechanism of claim 1, wherein each of the housing and the adjustment lever comprises sheet metal.

5. The chair height adjustment mechanism of claim 1, wherein the post has an upper stop and a lower stop each configured to limit a range of motion of the post and the chair seat.

6. A chair height adjustment mechanism comprising:

a chair having a base configured to support the chair on a surface and a chair seat positioned above the base;

a housing fixedly coupled to the base of the chair and slidably coupled to a post supporting the chair seat, the post extending through the housing, wherein a height of the chair seat above the base of the chair is dependent on a position of the post with respect to the housing;

an adjustment lever positioned within the housing, the adjustment lever having a constrained end, a free end distal to the constrained end protruding from the housing, and at least two plates extending between the constrained end and the free end, wherein the post extends through the at least two plates and wherein the at least two plates are joined by at least one spring configured to bias the at least two plates in opposite directions and clamp the post with the at least two plates; and a lever support within the housing configured as a fulcrum for the adjustment lever, wherein the lever support is positioned to hold the constrained end of the adjustment lever between the lever support and the housing;

wherein the free end of the adjustment lever is movable between a locked position and an active position, wherein when the free end is in the locked position, the height of the chair seat above the base of the chair is fixed, and wherein when the free end is in the active position, the height of the chair seat above the base of the chair is adjustable; and wherein when an upward force is exerted on the post with respect to the housing, the post is configured to pull the free end of the adjustment lever into the active position, and wherein the adjustment lever is configured to move into the locked position when the chair seat moves downward with respect to the base unless the adjustment lever is manually maintained in the active position.

7. The chair height adjustment mechanism of claim 6, the housing having an upper plate with an upper aperture extending therethrough and a lower plate with a lower aperture extending therethrough, wherein the lower plate is joined to the upper plate by a housing wall and wherein the post extends through the upper aperture and the lower aperture.

8. The chair height adjustment mechanism of claim 7, wherein the lever support is integrated into at least one of the housing wall, the upper plate and the lower plate, and wherein the lever support is positioned to hold the constrained end of the adjustment lever between the lever support and the upper plate.

9. The chair height adjustment mechanism of claim 6, wherein, when the adjustment lever is in the locked position, the adjustment lever is angled with respect to the post.

10. The chair height adjustment mechanism of claim 6, further comprising an intermediate plate positioned between the at least two plates, wherein the at least one spring passes through the intermediate plate without engaging with the intermediate plate.

11. A furniture height adjustment mechanism comprising:

a housing slidably coupled to a post extending through the housing; and an adjustment lever positioned within the housing, a free end of the adjustment lever protruding from the housing, wherein the adjustment lever has at least two plates joined by at least one spring configured to bias the at least two plates in opposite directions;

wherein the free end of the adjustment lever is movable between a locked position and an active position, wherein when the free end is in the locked position, a position of the post with respect to the housing is fixed, and wherein when the free end is in the active position, the position of the post with respect to the housing is adjustable.

12. The furniture height adjustment mechanism of claim 11, the housing having an upper plate and a lower plate, wherein the lower plate is joined to the upper plate by a housing wall.

13. The furniture height adjustment mechanism of claim 12, further comprising a lever support configured as a fulcrum for the adjustment lever, the adjustment lever having a constrained end distal to the free end positioned between the lever support and the upper plate.

14. The furniture height adjustment mechanism of claim 13, wherein the lever support is integrated into the housing wall.

15. The furniture height adjustment mechanism of claim 11, wherein when an upward force is exerted on the post with respect to the housing, the post is configured to pull the free end of the adjustment lever into the active position, allowing the post to move upward with respect to the housing.

16. The furniture height adjustment mechanism of claim 11, wherein when a downward force is exerted on the post with respect to the housing without an upward force being exerted on the adjustment lever while the adjustment lever is in the active position, the post is configured to pull the free end of the adjustment lever into the locked position as the post moves downward with respect to the housing.

17. The furniture height adjustment mechanism of claim 11, wherein, when the adjustment lever is in the locked position, the adjustment lever is angled with respect to the post.

18. The furniture height adjustment mechanism of claim 11, wherein the height adjustment mechanism is configured to control a vertical position of a chair seat.

19. The furniture height adjustment mechanism of claim 11, further comprising an intermediate plate positioned between the at least two plates, wherein the at least one spring passes through the intermediate plate without engaging with the intermediate plate.

20. The furniture height adjustment mechanism of claim 11, further comprising a chair having a base configured to support the chair on a horizontal surface and a chair seat positioned above the base and mounted to the post, wherein a height of the chair seat above the base of the chair is dependent on the position of the post with respect to the housing.

* * * * *